United States Patent [19]

Glidden

[11] 4,298,319

[45] Nov. 3, 1981

[54] HYDRAULIC GEAR PUMP OR MOTOR WITH FLOATING WEAR PLATES, BALANCE ASSEMBLY, AND UNITARY LOAD BEARING AND ALIGNMENT MEANS

[75] Inventor: James L. Glidden, Kalamazoo, Mich.

[73] Assignee: General Signal Corporation, Stamford, Conn.

[21] Appl. No.: 88,968

[22] Filed: Oct. 29, 1979

[51] Int. Cl.[3] ..... F03C 2/08; F04C 2/18; F04C 15/00

[52] U.S. Cl. ..... 418/132

[58] Field of Search ..... 418/131–135

[56] References Cited

U.S. PATENT DOCUMENTS

| | | | |
|---|---|---|---|
| 2,714,856 | 8/1955 | Kane | 418/132 |
| 3,063,378 | 11/1962 | Hart | 418/79 |
| 3,131,643 | 5/1964 | Marietta | 418/132 |
| 3,291,053 | 12/1966 | Gordon | 418/132 |
| 3,421,769 | 1/1969 | Boop et al. | 277/58 |

*Primary Examiner*—John J. Vrablik

*Attorney, Agent, or Firm*—Thomas R. FitzGerald; Jeffrey S. Mednick

[57] ABSTRACT

A fluid gear pump or motor has a central housing with an end cover on one side and an adapter cover on the other. A pair of gears are rotatable inside the housing and one gear shaft extends through the adapter cover for attachment to another machine. The adapter cover is mechanically grounded to the attached machine. Internal loads on the gear shafts are transmitted to the bearings on either end of the shafts in the two covers. One centering plate transmits the loads from one pair of bearings in the end cover to the housing. Another centering plate transmits the loads from the housing and the other bearings to the grounded adapter cover.

3 Claims, 4 Drawing Figures

HYDRAULIC GEAR PUMP OR MOTOR WITH FLOATING WEAR PLATES, BALANCE ASSEMBLY, AND UNITARY LOAD BEARING AND ALIGNMENT MEANS

BACKGROUND OF THE INVENTION

This invention relates, in general, to hydraulic gear pumps and motors and especially to gear pumps and motors operable at sustained high pressures.

Hydraulic gear pumps or motors are well-known fluid machines. Such machines generally consist of a central housing with a gear pocket, an end cover, and an adapter cover. A pair of meshed gears are rotatably mounted inside the housing. The gears may be keyed to, or integral with, their gear shafts which are rotatably supported by bearings located in the covers of the machine. One gear shaft extends through the adapter cover for connection to a drive shaft. In the case of a pump, fluid enters the machine through a low pressure inlet adjacent to a point where the volume between the gears is increasing. The fluid is then carried between the teeth of the gears around the outer periphery of the gear pocket to a point where the gears begin to mesh and the volume between the gears is decreasing. There fluid is forcibly discharged through a high pressure outlet.

The longevity of a gear-type hydraulic machine depends upon a number of factors, including the alignment of the gears with each other, the gear-to-housing contact, the load on the bearings and the operating pressure. Those skilled in the art will recognize that the higher the operating pressure, the more detrimental are the effects of misalignment, excessive housing contact, and bearing load. Others have attempted to compensate for the deleterious effects of sustained high pressure operation by providing fluid machines having heavier housings or covers, high precision machining of the components, sealing off the bearings from the high fluid pressures, and by providing one-piece wear plate and bushing supports which are in turn supported in the end and adapter covers.

Examples of the latter type of combination wear plate and support member are found in U.S. Pat. Nos. 3,421,769 and 2,714,856. In order for a single structural member to accommodate all of the loads created by the high pressure forces, it is necessary that the wear plate be precisely machined and that the housing and the end covers be relatively massive and thick-walled to accommodate all of the loads. Accordingly, such machines are difficult to produce and are also expensive due to the precision machining and extra material that are shown in U.S. Pat. No. 3,063,378. There, a wear plate is used to maintain the alignment of the gears. Spaced on the wear plate are two pairs of cooperating split spacer rings which fit around each of the four bearings that support the gear shafts. However, the split spacer rings do not prevent high pressure fluid from entering the bearings and there is no provision for replenishing or exchanging the fluid in the drive shaft bearings.

SUMMARY OF THE INVENTION

It is an object of this invention to provide a new and useful power machine.

It is a further object of this invention to provide a fluid gear pump or motor having a unitary load-bearing and alignment means.

It is a further object of this invention to provide a fluid gear pump or motor having a wear plate, a balancing assembly and a centering plate.

It is still another object of this invention to have a fluid gear pump or motor with a centering place disposed inside the housing and spaced from the gears.

The fluid gear pump or motor of the invention includes a three layer wear plate, balancing and centering (or alignment) arrangement. The arrangement is positioned between each end of the gears and the respective end cover or adapter cover. Hence, each gear pump or motor has two such arrangements. The layer closely adjacent the gear face is a floating wear plate. The next layer includes a balancing assembly with fluid channels designed to bring high pressure fluid from the outlet to areas adjacent to the inlet in order to balance the load upon the gears. The third layer is a centering plate. The centering plate functions to maintain the gears, the bearings, the housing, as well as the end and adapter covers, in a predetermined alignment with one another. One centering plate transmits loads from the end cover and one set of bearings to the housing. The other centering plate receives the loads from the housing and transmits the loads to the other set of bearings. The load on the bearings is received by the adapter cover which is mechanically grounded, (i.e. relatively fixed in space) by being attached to a prime mover, such as an electric motor. By transmitting the internal loads in the aforesaid manner, the centering plates achieve a state of equilibrium. The centering plate includes pilot recesses for receiving extended portions of the bearings in order to orient the bearings and bring the gear shafts into a predetermined axial alignment and thereby confine the gear-to-housing contact to within a desirable zone.

Each centering plate of the invention has a peripheral surface in contact with the housing and an outer end surface is in contact with either the end cover or the adapter cover.

As a result of the unique construction of the gear pump or motor of this invention, the bearings are sealed from direct fluid communication with the high pressure fluid of the pump or motor. In addition, the efficient transmission of internal loads to the housing end and adapter covers makes it possible to use lighter weight covers.

The foregoing objects and summary of the present invention will be better understood by reference to the following detailed description and the accompanying drawings.

DRAWINGS

DETAILED DESCEIPTION

Figure 1:
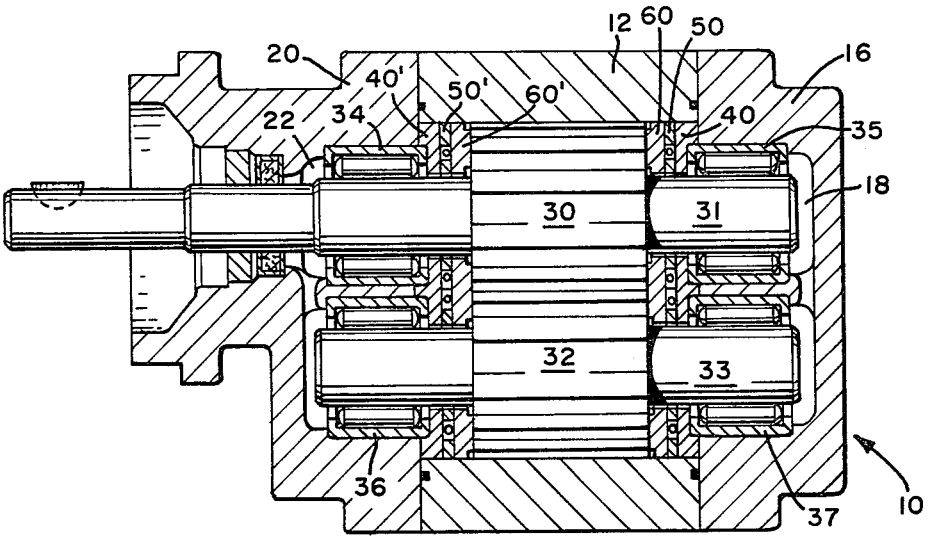
FIG. 1 is a vertical sectional view of a pump embodying the principles of the present invention.

Referring in detail to the drawings, particularly FIG. 1, there is provided a pump 10 which could be adapted for use as a motor. Pump 10 has a pair of intermeshing impeller gears 30, 32 that are rotatably mounted between an adapter cover 20 and an end cover 16 and a central housing 12. The gears 30, 32 are respectively mounted for rotation upon gear shafts 31, 33. Two pairs of suitable anti-friction bearings such as needle bearings 34–37 rotatably support gear shafts 31, 33. Other supports, such as bushings or roller bearings, could also be used to support gear shafts 31, 33. Gear drive shaft 31, extends through the adapter cover 20 for connection to a source of drive power. Spaced between end cover 16 and the side faces of gears 30, 32 is a three layer arrangement including a centering plate 40, a balancing assembly 50 and a wear plate 60. Accordingly, further discussion will be limited to members 40, 50, and 60; those skilled in the art will recognize that the same comments apply to members 40', 50' and 60'.

Figure 2:
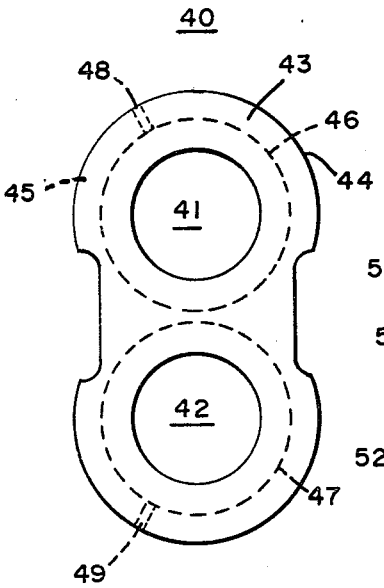
FIG. 2 is a detailed view of the centering plate of the invention.

Centering plate 40 is spaced from the intermeshing gears 30, 32 by balancing assembly 50 and floating wear plate 60. With reference to FIG. 2, the centering plate 40 has a general figure eight configuration including two circular openings 41, 42 to accommodating gear shafts 31, 33. An inner facing end surface 43 faces the spaced gears 40, 32; and a peripheral surface 44 is in contact with central housing 12; and an outer facing end surface 45 is in contact with end cover 16. A pair of annular recesses 46, 47 are provided in outer end surface 45. The annular recesses 46, 47 provide pilot means for receiving a portion of needle bearings 35, 37 that project toward central housing 12. A pair of seals 48, 49 are optionally provided in outer end surface 45. Thus, it will be seen that any radial loads from the gear shafts 31, 33 or bearings 35, 37 are transmitted through the centering plate 40 to the housing 12. Transverse loads on end cover 16 are transmitted to centering plate 40 by means of its two openings 41, 42 and its pilot recesses 46, 47. Centering plate 40 is thus capable of aligning gears shafts 31, 33 and bearings 35, 37 with each other and with the central housing 12 and end cover 16. Centering plate 40' receives the transverse loads from central housing 12 and transmits those those to adapter cover 20 via pilot recesses 46',47' and bearings 34,36. A prime mover (not shown) such as an electric motor mechanically grounds the adapter cover 20 to a relatively fixed position in space.

Figure 4:
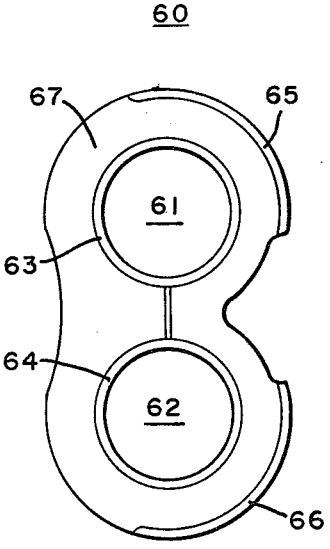
FIG. 4 is a wear plate of the invention.

With reference to FIG. 4, the wear plate 60 of the invention is of the floating-type design. Hence, there is some slight tolerance for transverse movement of the wear plate 60. Wear plate 60 is also of a general figure eight configuration and includes two openings 61, 62 for accommodating gear shafts 31, 33. A gear facing surface 67 has a bronze coating and further includes relief recesses 65, 66.

Figure 3:
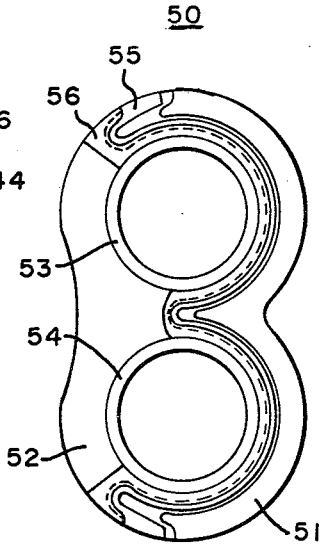
FIG. 3 is a detailed view of the balance detail of the invention.

A multi-component balancing assembly 50 is disposed between wear plate 60 and centering plate 40. The balancing assembly 50, 50' seals off the high pressure outlet fluid from the low pressure side and thus develops an axial force that urges wear plates 60, 60' against the sides of gears 30, 32, thereby maintaining the volumetric efficiency of the pump 10. The balancing assembly 50 has a figure eight configuration. As shown in FIG. 3, it includes a figure three shaped nylon insert 51 adjacent to the high pressure outlet. Opposite the nylon insert 51 is a steel insert 52. Balancing assembly 50 also has two steel spacer rings 53, 54 to support hydraulic load transmitted through a nylon back-up member 56. Between the nylon insert 51, and the steel insert 52 and steel spacer rings 53, 54 is a roughly figure three shaped rubber seal 55 that is located in place by the nylon back-up member 56.

In operation, as the gear shaft 31 is turned, fluid is drawn in through a low pressure inlet (not shown) opposite the low pressure inlet. As the pressure of the output increases, the central housing 12 tends to move in one direction and the end cover 16 moves in an opposite direction; the adapter cover 20 remains fixed to its prime mover (not shown). Load from end cover 16 and from pilot recesses 46, 47 are transmitted through the bearings 35, 36 into the centering plate 40 and from there onto central housing 12, and from central housing 12 into centering plate 40', to bearings 34, and 36 into adapter cover 20 thereby establishing a state of equilibrium.

Thus, the wear plates 60, 60' need not be precisely machined and are free to float against the gears 30, 32. The high pressure seal is maintained by the balancing assemblies 50, 50' so that little or no high pressure fluid reaches bearings 34, 36. Accordingly, with the high fluid pressure and operating loads fully accounted for, the end cover 16 and adapter cover 20 need not be as massive as those of the prior art. Thus, the invention provides for a lighter weight pump 10.

A preferred embodiment of the invention having been thus described, those skilled in the art will recognize that further improvements or modifications can be made without departing form the spirit and scope of the invention as defined in the appended claims.

What is claimed is:

1. A fluid gear pump or motor apparatus comprising:

(a) a housing having an inlet and an outlet;

(b) an end cover and an adapter cover jointed to opposite ends of said housing;

(c) a pair of meshed gears in said housing, each gear being rotatably mounted on a corresponding gear shaft that extends into said end cover and into said adapter cover;

(d) bearings mounted in said end and adapter covers for rotatably supporting said gear shafts; and (e) a pair of floating wear plates, each wear plate having a pair of openings through which the gear shafts pass, said openings having a degree of tolerance to allow movement of the wear plate transverse to said gear shaft, and relief recesses in the periphery of said plates, (f) a pair of balance assemblies, each one operatively associated with a wear plate and adjacent the surface of the wear plate opposite the wearing surface, each balance assembly including a seal member for sealing off the inlet from the outlet and developing an axial fluid force directed towards the wear plate for urging the wearing surface of the wearplate against the gears in order to maintain the volumetric efficiency of the apparatus, and (g) substantially rigid and substantially unmoveable unitary load bearing and alignment means disposed inside said housing, spaced from said gears and between the respective bearings and balance assemblies and contacting said housing, bearings and respective end or adapter cover for maintaining said gears in a predetermined alignment with one another and for transmitting transverse loads on said end cover and housing to said adapter cover, whereby the transverse loads on said pump or motor are maintained in a state of equilibrium.

2. The gear pump or motor of claim 1 wherein said bearings at least partially extend from said covers into said housing and said unitary load bearing means further comprises pilot means for receiving said extended portion of said bearing means for orienting said bearings in order to bring said gear shafts into a predetermined axial alignment and thereby confine gear-to-housing contact to within a desirable zone.

3. The gear pump or motor of claim 1 wherein unitary load bearing means includes a pair of centering plates, each having:

(a) a peripheral surface in contact with said housing;

(b) an outer end surface in contact with one of said end and adapter covers, and an inner end surface being spaced from said gears; and (c) annular pilot recesses in said outer end surface for receiving that portion of said bearing means that extends into said housing.

* * * * *